US010885871B2

(12) United States Patent
Amirkhany

(10) Patent No.: US 10,885,871 B2
(45) Date of Patent: Jan. 5, 2021

(54) SCALABLE DRIVING ARCHITECTURE FOR LARGE SIZE DISPLAYS

(71) Applicant: Samsung Display Co., Ltd., Yongin-si, Gyeonggi-do (KR)

(72) Inventor: Amir Amirkhany, Sunnyvale, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/271,542

(22) Filed: Feb. 8, 2019

(65) Prior Publication Data

US 2019/0287480 A1 Sep. 19, 2019

Related U.S. Application Data

(60) Provisional application No. 62/643,119, filed on Mar. 14, 2018.

(51) Int. Cl.
*G09G 5/00* (2006.01)

(52) U.S. Cl.
CPC ..... *G09G 5/006* (2013.01); *G09G 2340/02* (2013.01); *G09G 2370/14* (2013.01)

(58) Field of Classification Search
CPC ..... G09G 5/006; G09G 5/04; G09G 2310/08; G09G 2340/02; G09G 2360/128; G09G 2360/18; G09G 2370/00
USPC ..... 345/204, 210
See application file for complete search history.

(56) References Cited

U.S. PATENT DOCUMENTS

| | | | | |
|---|---|---|---|---|
| 7,834,869 | B2 | 11/2010 | Kondo et al. | |
| 9,001,017 | B2 | 4/2015 | Moon et al. | |
| 9,082,364 | B2 | 7/2015 | Lin et al. | |
| 9,307,248 | B2 | 4/2016 | Wu et al. | |
| 9,514,705 | B2 | 12/2016 | Ju et al. | |
| 9,767,766 | B2 | 9/2017 | Oh et al. | |
| 9,824,660 | B2 | 11/2017 | Park et al. | |
| 9,830,872 | B2 | 11/2017 | Kim | |
| 2004/0239655 | A1 | 12/2004 | Tani et al. | |
| 2005/0219193 | A1 | 10/2005 | Nagaoka et al. | |
| 2007/0013774 | A1* | 1/2007 | Maeng | G02F 1/13306 348/87 |
| 2011/0095804 | A1* | 4/2011 | Kumar | H03K 19/01852 327/333 |

(Continued)

OTHER PUBLICATIONS

Office action issued in U.S. Appl. No. 16/271,511 by the USPTO, dated Sep. 19, 2019, 25 pages.

(Continued)

*Primary Examiner* — Jacinta M Crawford
(74) *Attorney, Agent, or Firm* — Lewis Roca Rothgerber Christie LLP

(57) ABSTRACT

A scalable driving architecture for large size display includes a display; a low voltage integrated circuit configured to: receive a high-speed input signal; process the input signal; and output uncompressed pixel data based on the processed input signal; and a first high voltage integrated circuit configured to drive pixels in the display based on the uncompressed pixel data; wherein the low voltage integrated circuit is configured to provide the uncompressed pixel data to the first high voltage integrated circuit via a first low-to-high (L2H) interface, and wherein the low voltage integrated circuit and the first high voltage integrated circuit are assembled on a film.

14 Claims, 4 Drawing Sheets

(56) References Cited

U.S. PATENT DOCUMENTS

| | | | | |
|---|---|---|---|---|
| 2013/0241960 | A1 | 9/2013 | Xu | |
| 2014/0091998 | A1* | 4/2014 | Ko | G09G 3/3674 345/100 |
| 2016/0188062 | A1* | 6/2016 | Jung | G06F 3/044 345/173 |
| 2016/0203802 | A1* | 7/2016 | Hong | G09G 5/006 345/534 |
| 2016/0275893 | A1 | 9/2016 | Tanaka et al. | |
| 2016/0345022 | A1 | 11/2016 | Ju et al. | |
| 2017/0069289 | A1* | 3/2017 | Oh | H04N 5/44 |
| 2017/0187551 | A1* | 6/2017 | Lukanc | H04L 25/03019 |
| 2017/0308226 | A1 | 10/2017 | Yoo et al. | |

OTHER PUBLICATIONS

U.S. Notice of Allowance dated Jul. 6, 2020, issued in U.S. Appl. No. 16/271,511 (12 pages).

* cited by examiner

SCALABLE DRIVING ARCHITECTURE FOR LARGE SIZE DISPLAYS

CROSS-REFERENCE TO RELATED APPLICATION(S)

The present application claims priority to and the benefit of U.S. Provisional Patent Application No. 62/643,119 filed on Mar. 14, 2018, the content of which is incorporated herein by reference in its entirety. This application is further related to U.S. patent application Ser. No. 16/271,511, filed Feb. 8, 2019, the entire content of which is incorporated herein by reference.

BACKGROUND

1. Field

One or more aspects of embodiments disclosed herein relate to a system and method for a display interface.

2. Description of Related Art

Displays for large size devices such as televisions (TV) and computers continue to become increasingly capable with each successive generation. Generally, each generation has higher resolutions, greater color space, increased brightness, and increased contrast ratios. For example, the number of pixel columns in a display has increased from 1080 columns in FullHD displays to 2160 columns in 4 k displays to 4360 columns in 8 k displays.

Generally, in large size displays, each column is driven by an integrated circuit (e.g., a Source IC). Due to manufacturing reasons, each Source IC can have a limited length and width, and the maximum length of the Source IC typically limits the number of output ports which determines the number of columns that can be driven by a single Source IC. Therefore, an increase in the number of columns in a display requires a subsequent increase in the number of Source ICs to drive those columns. In the case of the number of columns doubling, the number of Source ICs also doubles. Because each Source IC has an individual input interface, the number of input interfaces and the traces to those interfaces also doubles. Additionally, the width of PCB/connector to those traces also doubles. A new architecture is therefore desired to avoid this doubling in components and increased input interface size and complexity.

The display architecture for a larger format display device differs from other display technologies such as the display architecture for a mobile phone or tablet. One common difference is that the display architecture for a larger format display device has a timing controller that is separate from the Source IC. The timing controller is located on one board the Source IC is located on another. The Source IC is high voltage and the timing controller is low voltage and may contain an advance process. Thus, the display architecture may be modified for lager format display.

The above information disclosed in this Background section is only for enhancement of understanding of the background and therefore it may contain information that does not constitute prior art.

SUMMARY

Aspects of embodiments of the present disclosure are directed toward a system and method for a scalable driving architecture for large size displays.

According to some example embodiments of the present disclosure, a display architecture includes a display; a low voltage integrated circuit configured to: receive a high-speed input signal; process the input signal; and output uncompressed pixel data based on the processed input signal; and a first high voltage integrated circuit configured to drive pixels in the display based on the uncompressed pixel data; wherein the low voltage integrated circuit is configured to provide the uncompressed pixel data to the first high voltage integrated circuit via a first low-to-high (L2H) interface, and wherein the low voltage integrated circuit and the first high voltage integrated circuit are assembled on a film.

According to some example embodiments, the input signal includes an encoded signal.

According to some example embodiments, the low voltage integrated circuit is stacked on top of the first high voltage integrated circuit.

According to some example embodiments, the display architecture includes a second high voltage integrated circuit configured to drive pixels in the display based on the uncompressed pixel data; wherein the low voltage integrated circuit is configured to split the input signal into a first stream and a second stream and configured to provide the first stream to the first high voltage integrated circuit via the first L2H interface and provide the second stream to the second high voltage integrated circuit via a second L2H interface, and wherein the second high voltage integrated circuit is assembled on the film.

According to some example embodiments, the second L2H interface includes a low-voltage differential signaling (LVDS) interface.

According to some example embodiments, the low voltage integrated circuit is manufactured using a first process and the first high voltage integrated circuit is manufactured using a second process.

According to some example embodiments, the first process is more advanced than the second process.

According to some example embodiments, the first L2H interface includes a LVDS interface.

According to some example embodiments of the present disclosure, in a method for transmitting a signal to a display includes: receiving, by a low voltage integrated circuit, an input signal; storing, by the low voltage integrated circuit, the input signal; processing, by the low voltage integrated circuit, the input signal; outputting, by the low voltage integrated circuit, uncompressed pixel data based on the processed input signal; transmitting, by the low voltage integrated circuit, uncompressed pixel data to a first high voltage integrated circuit via a first low-to-high (L2H) interface; receiving, by the high voltage integrated circuit, uncompressed pixel data; and driving, by the high voltage circuit, uncompressed pixel data onto the display.

According to some example embodiments, the input signal includes an encoded input signal.

According to some example embodiments, the method for transmitting a signal to a display includes transmitting, by the low voltage integrated circuit, uncompressed pixel data to a second high voltage integrated circuit via a second low-to-high (L2H) interface; receiving, by the second high voltage integrated circuit, uncompressed pixel data; and driving, by the second high voltage integrated circuit, uncompressed pixel data onto the display.

According to some example embodiments, the second L2H interface includes a low-voltage differential signaling (LVDS) interface.

According to some example embodiments, the low voltage integrated circuit is manufactured using a first process and the first high voltage integrated circuit and the second high voltage integrated circuit are manufactured using a second process.

According to some example embodiments, the first process is more advanced than the second process.

According to some example embodiments, the first L2H interface includes a LVDS interface.

According to some example embodiments of the present disclosure, a display architecture includes: a display; a low voltage integrated circuit configured to: receive an input signal; process the input signal; and output uncompressed pixel data based on the processed input signal; a first high voltage integrated circuit configured to drive pixels in the display based on the uncompressed pixel data; and a second high voltage integrated circuit configured to drive pixels in the displayed based on the uncompressed pixel data; wherein the low voltage integrated circuit is configured split the input signal into a first stream and a second stream and configured to provide the first stream to the first high voltage integrated circuit via a first low-to-high (L2H) interface, and wherein the low voltage integrated circuit is configured to provide the second stream to the second high voltage integrated circuit via a second low-to-high (L2H) interface, and wherein the low voltage integrated circuit, the first high voltage integrated circuit, and the second high voltage integrated circuit are assembled on a film.

According to some example embodiments, the input signal includes an encoded input signal.

According to some example embodiments, the low voltage integrated circuit is manufactured using a first process and the first high voltage integrated circuit and second high voltage integrated circuit are manufactured using a second process.

According to some example embodiments, the first process is more advanced than the second process.

According to some example embodiments, the first L2H interface includes a low-voltage differential signaling (LVDS) interface and the second L2H interface includes a LVDS interface.

BRIEF DESCRIPTION OF THE DRAWINGS

Some embodiments can be understood in more detail from the following description taken in conjunction with the accompanying drawings, of which.

DETAILED DESCRIPTION

In various embodiments, a low power display architecture may include a hybrid display panel interface that utilizes integrated circuits that include different process technologies (e.g., a 65 nm low voltage process and a 130 nm high voltage process). In various embodiments, the integrated circuits are assembled on the same film and include a parallel interface between them. In various embodiments, a first integrated circuit includes an input interface configured to connect to and receive display data from a timing controller. In various embodiments, the first integrated circuit was constructed using a more advanced process such as 65 nm or less semiconductor process. In various embodiments, the first integrated circuit includes a first output parallel interface for relaying pixel data, via the first parallel interface, to a second integrated circuit. In various embodiments, the first integrated circuit includes a second output parallel interface for relaying pixel data, via the second parallel interface, to a third integrated circuit. In various embodiments, the first parallel interface is configured to carry uncompressed pixel data between the first integrated circuit and the second integrated circuit. In various embodiments, the second parallel interface is configured to carry uncompressed pixel data between the first integrated circuit and the third integrated circuit. In various embodiments, the first and second parallel interfaces are un-terminated at the receiver sides, are low swing, and at any instance in time include sub-pixel data. In various embodiments, the second integrated circuit receives the pixel data from the first integrated circuit via the first parallel interface and outputs the pixel data to the display panel columns using pixel drivers. In various embodiments, the third integrated circuit receives the pixel data from the first integrated circuit via the second parallel interface and outputs the pixel data to the display panel columns using pixel drivers. In various embodiments, the second and third integrated circuits were constructed using a less advanced process such as 130 nm semiconductor process.

Figure 1:
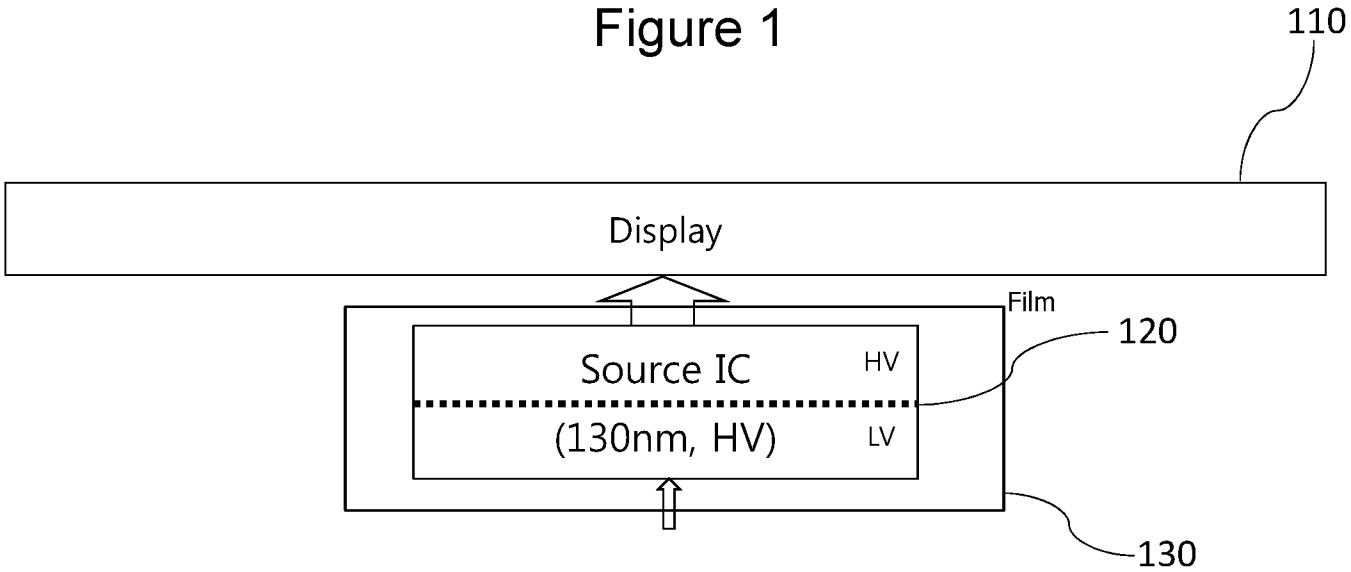
FIG. 1 is a system diagram of a related art display architecture for a larger format display device.

FIG. 1 is a system diagram of a related art display architecture for a larger format display device.

Referring to FIG. 1, the display architecture contains a Source IC 120. The Source IC 120 has a high voltage (HV) output interface and a low voltage (LV) input interface. The Source IC 120 may be encased by a film 130. Additionally, the Source IC 120 may be coupled to the display 110. In some embodiments, the display 110 may be the display screen on a television.

According to this embodiment, the Source IC 120 receives a video signal from an application processor at its input. In some embodiments, the video signal may be an encoded signal. The video data includes sub-pixel data that may include, but is not limited to, red-green-blue (RGB), red-green-blue-green (RGBG), red-blue-green-white (RGBW), red-green (RG), and red (R) data. After receiving the signal, the Source IC 120 processes the signal. In some embodiments, processing the signal may be decoding an encoded signal. The Source IC 120 then drives the pixels on the display 110 according to the signal.

In this example, the number of output channels in the Source IC 120 cannot scale proportionally. The output channels are limited by the output channel minimum pitch and the Source IC chip size, which can be, for example, 30 millimeters (mm) wide. As a result, any increase in the number of display columns requires an increase in the number of Source IC's. Thus, with the transition from FullHD (1920 columns) to 4 k (3840 columns) to 8 k (7680 columns) displays has resulted in a doubling in the number of columns with each generation. Each Source IC has its own input interface and as the number of Source IC's doubles, the number of interface traces doubles, resulting in the Printed Circuit Board (PCB)/connector width doubling. Even if the number of interface traces could remain, the Source IC process is too slow to handle the doubling of the interface speed.

Figure 2:
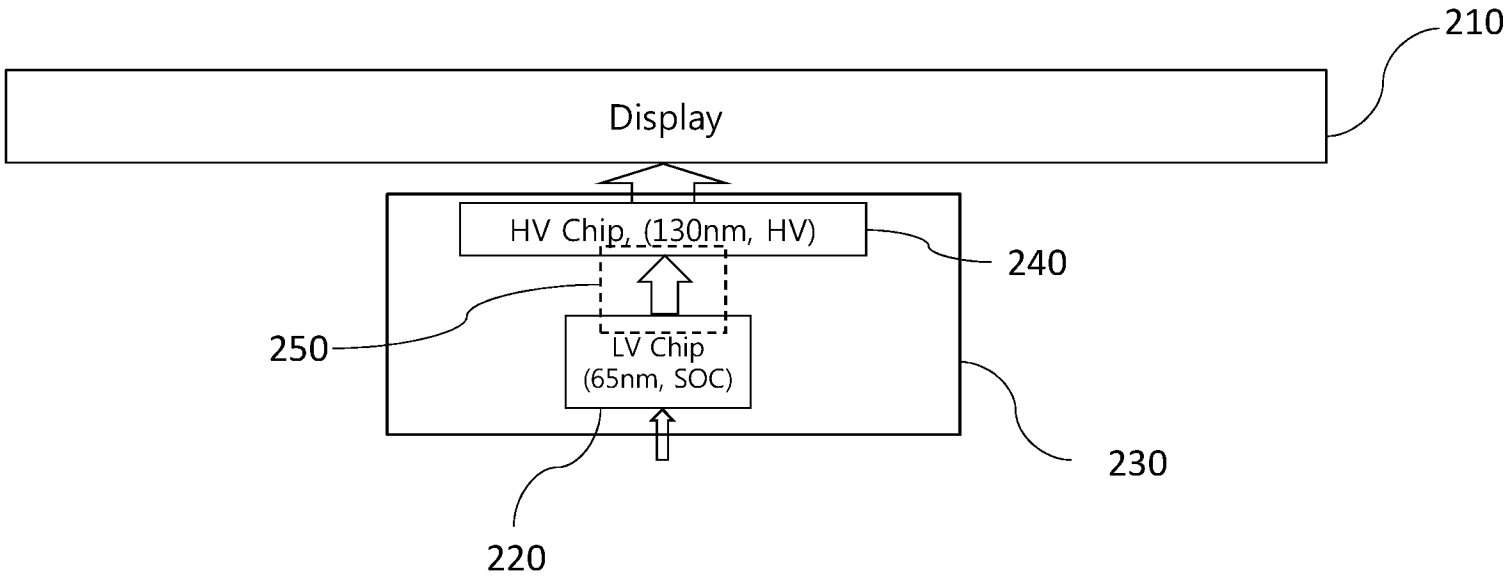
FIG. 2 is a system diagram of a display architecture for a large format display device according to one embodiment of the present disclosure.

FIG. 2 is a system diagram of a display architecture for a large format display device according to one embodiment of the present disclosure.

Referring to FIG. 2, this embodiment incorporates two integrated circuits for the steps of signal processing and driving the pixels of the signal onto the display. One integrated circuit is a high voltage (HV) chip 240 and the second chip may be a low voltage (LV) chip 220. According to this embodiment, the HV chip 240 is coupled to a display 210. The HV chip 240 is also coupled to the LV chip 220 through an interface 250. In some embodiments, the LV chip 240 can be stacked on top of the HV chip 220 with a 2.5D or 3D integration technique. In some embodiments, the interface 250 may be a low-to-high (L2H) interface. In some embodiments, the L2H interface may be any low-power parallel interface such as a voltage differential signaling (LVDS) interface or other proprietary interfaces. The width of the interface 250 can be selected to be substantially optimized for a reduced power consumption. The HV chip 240 and the LV chip 220 may be assembled on the same film 230.

In various embodiments, the HV chip 240 is a level-shifter configured to drive pixels in the display 210. In some embodiments, the HV chip 240 may be constructed using a 130 nm process.

In some embodiments, the LV chip 220 may be constructed using a 65 nm or smaller process. The LV chip 220 may use high-volume system on chip (SOC) process, which reduces cost. In this embodiment, the signal decoding and processing is performed at the LV chip 220.

The LV chip 220 is configured to receive a video stream from a timing controller at its input. In some embodiments, the video stream may be an encoded signal. The video data includes sub-pixel data that may include, but is not limited to, red-green-blue (RGB), red-green-blue-green (RGBG), red-blue-green-white (RGBW), red-green (RG), and red (R) data. After receiving the signal, the LV chip 220 processes the signal. For example, in some embodiments, the LV chip 220 splits the sub-pixel data into separate color streams. The LV chip 220 transmits the signal to the HV chip 240 across the interface 250. The HV chip 240 increases the voltage of the signal and drives the pixels of the signal onto the display 210.

Figure 3A:
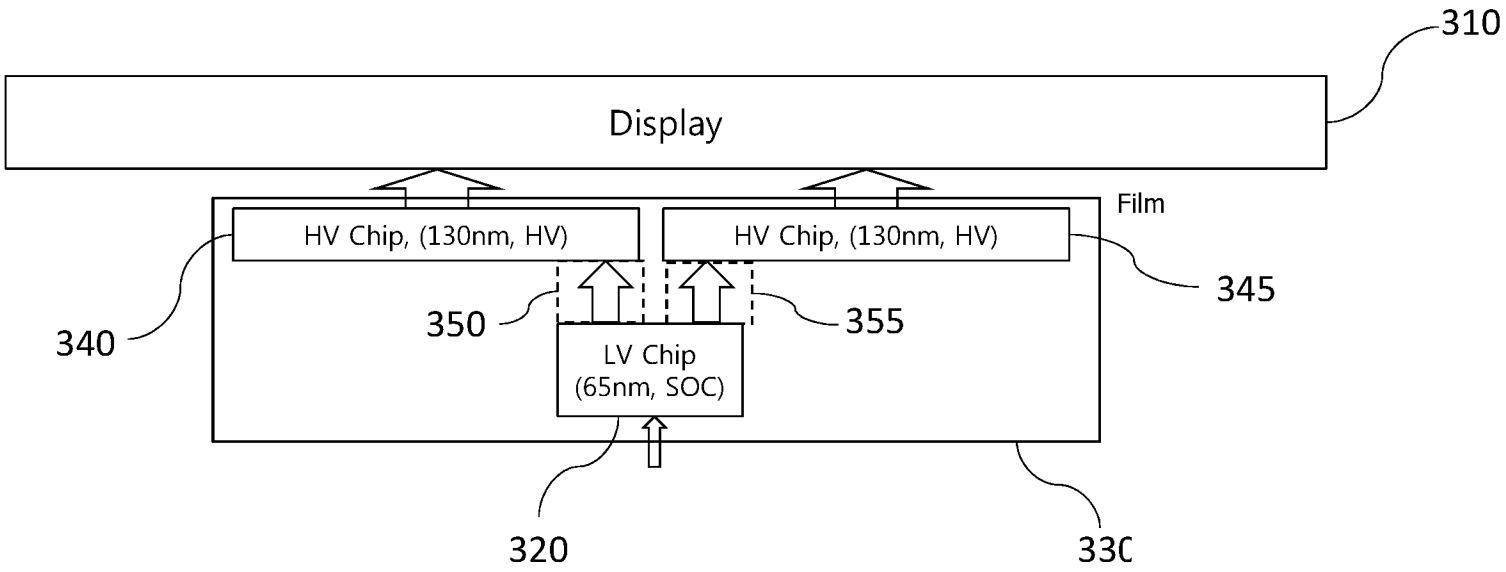
FIG. 3A is a system diagram of a display architecture for a display according to another embodiment of the present disclosure.

FIG. 3A is a system diagram of a display architecture for a display according to another embodiment of the present disclosure.

Referring to FIG. 3A, in this embodiment, the one LV chip may be configured to be used in conjunction with multiple HV chips. For example, this embodiment incorporates three integrated circuits for the steps of signal processing and driving the pixels of the signal onto the display. According to the current embodiment, the display architecture contains two HV chips 340 and 345. Both HV chip 340 and HV chip 345 are coupled to the display 310. The architecture also includes a single LV chip 320 that is coupled to HV chip 340 by interface 350 and is also coupled to HV chip 345 by interface 355. In some embodiments, the interfaces 350 and 355 may be low-to-high (L2H) interfaces. In some embodiments, the L2H interface may be any low-power parallel interface such as a voltage differential signaling (LVDS) interface or other proprietary interfaces. The HV chips 340 and 345, and the LV chip 320 are assembled on a film 330.

In this embodiment, the architecture allows for the doubling of the number of column drivers by duplicating the number of high voltage Source IC chips. For example, the LV chip 320 is configured to operate with the two HV chips 340 and 345. In order to support two HV chips 340, 345, the input interface speed of the LV chip 320 may be doubled. Similarly, a single LV chip 320 could support a third, fourth, or more HV chips 340, 345 by correspondingly increasing the input interface speed (e.g., triple, quadruple, or more).

Figure 3B:
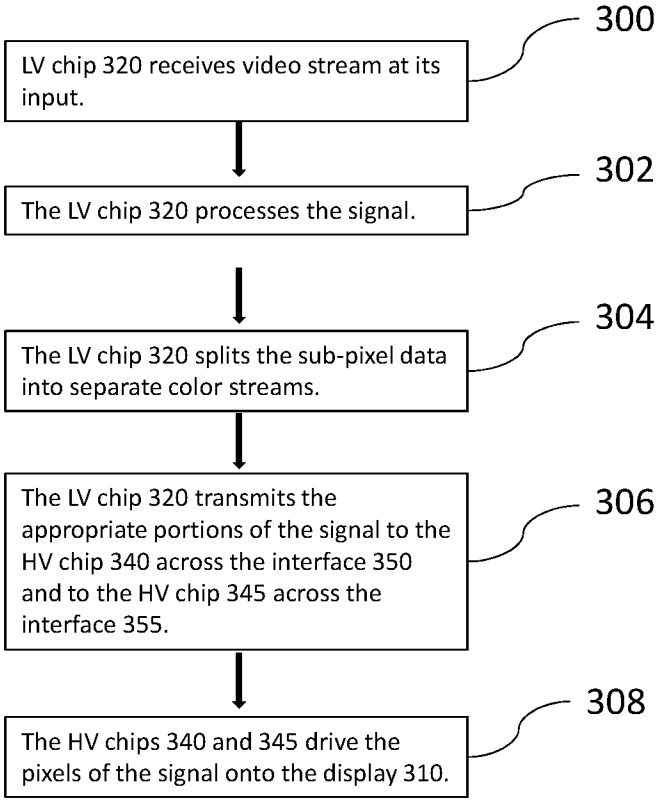
FIG. 3B displays a flow diagram illustrating the transmission of a signal through the architecture shown in FIG. 3A.

FIG. 3B displays a flow diagram illustrating the transmission of a signal through the architecture shown in FIG. 3A.

In Step 300, the LV chip 320 is configured to receive a video stream from a timing controller at its input. In some embodiments, the video stream may be an encoded signal. The signal comprises video data corresponding to the columns being driven by the HV chips 340, 345. The video data includes sub-pixel data that may include, but is not limited to, red-green-blue (RGB), red-green-blue-green (RGBG), red-blue-green-white (RGBW), red-green (RG), and red (R) data. After receiving the signal, the LV chip 320 processes the signal in Step 302. For example, in some embodiments, the LV chip 320 splits the sub-pixel data into separate color streams as shown in Step 304. Then, in Step 306, the LV chip 320 transmits the appropriate portions of the signal to the HV chip 340 across the interface 350 and to the HV chip 345 across the interface 355. In Step 308, the HV chips 340 and 345 drive the pixels of the signal onto the display 310.

The embodiments of the present disclosure provide several advantages to current display architectures for large size displays. The architecture of the current disclosure significantly reduces the total silicon area and the input interface area by using smaller low voltage chips. Additionally, the present disclosure significantly reduces the input interface power by using small low voltage chips. Also, the yield in the high voltage (HV) chip does not impact the low voltage (LV) chip and vice versa. The HV noise and heat do not impact the LV yield.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

Features of the inventive concept and methods of accomplishing the same may be understood more readily by reference to the aforementioned detailed description of embodiments and the accompanying drawings. The aforesaid embodiments were described in more detail with reference to the accompanying drawings, in which like reference numbers referred to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of embodiments of the present disclosure may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the previous description, for the purposes of explanation, numerous specific details were set forth to provide a thorough understanding of various embodiments. It is apparent, however, that various embodiments may be practiced without these specific details or with one or more equivalent arrangements. Further, one of ordinary skills in the art would appreciate that various features of two or more embodiments described herein may be combined in any suitable manner without departing from the spirit or scope of the present disclosure. In other instances, well-known structures and devices are shown in block diagram form in order to avoid unnecessarily obscuring various embodiments.

It is understood that when an element, layer, region, or component was referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it is understood that when an element or layer was referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicated otherwise. It is further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the disclosure refers to "one or more embodiments of the disclosure." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

What is claimed is:

1. A display architecture comprising:

a display;

a low voltage integrated circuit manufactured using a first semiconductor manufacturing process and configured to:

receive a high-speed input signal from a timing controller;

process the input signal; and output uncompressed pixel data based on the processed input signal; and a first high voltage integrated circuit manufactured using a second semiconductor manufacturing process, wherein the first semiconductor manufacturing process is a smaller process node than the second semiconductor manufacturing process, and configured to drive pixels in the display based on the uncompressed pixel data;

wherein the low voltage integrated circuit is configured to provide the uncompressed pixel data to the first high voltage integrated circuit via a first low-to-high (L2H) interface, and wherein the low voltage integrated circuit and the first high voltage integrated circuit are assembled on a film.

2. The display architecture according to claim 1, wherein the input signal comprises an encoded signal.

3. The display architecture according to claim 1, wherein the low voltage integrated circuit is stacked on top of the first high voltage integrated circuit.

4. The display architecture according to claim 1, wherein the display architecture further comprises:

a second high voltage integrated circuit manufactured using the second process and configured to drive pixels in the display based on the uncompressed pixel data;

wherein the low voltage integrated circuit is configured to split the input signal into a first stream and a second stream and configured to provide the first stream to the first high voltage integrated circuit via the first L2H interface and provide the second stream to the second high voltage integrated circuit via a second L2H interface, and wherein the second high voltage integrated circuit is assembled on the film.

5. The display architecture of claim 4, wherein the second L2H interface comprises a low-voltage differential signaling (LVDS) interface.

6. The display architecture according to claim 1, wherein the first L2H interface comprises a low-voltage differential signaling (LVDS) interface.

7. A method for transmitting a signal to a display comprising:

receiving, by a low voltage integrated circuit manufactured using a first process, an input signal from a timing controller;

storing, by the low voltage integrated circuit, the input signal;

processing, by the low voltage integrated circuit, the input signal;

outputting, by the low voltage integrated circuit, uncompressed pixel data based on the processed input signal;

transmitting, by the low voltage integrated circuit, uncompressed pixel data to a first high voltage integrated circuit via a first low-to-high (L2H) interface, wherein the first high voltage integrated circuit is manufactured using a second process, wherein the first process is a smaller process node than the second process;

receiving, by the first high voltage integrated circuit, uncompressed pixel data; and driving, by the first high voltage integrated circuit, uncompressed pixel data onto the display.

8. The method according to claim 7, wherein the input signal comprises an encoded input signal.

9. The method according to claim 7 further comprising transmitting, by the low voltage integrated circuit, uncompressed pixel data to a second high voltage integrated circuit via a second low-to-high (L2H) interface, wherein the second high voltage integrated circuit is manufactured using the second process;

receiving, by the second high voltage integrated circuit, uncompressed pixel data; and driving, by the second high voltage integrated circuit, uncompressed pixel data onto the display.

10. The method according to claim 9, wherein the second L2H interface comprises a low voltage differential signaling (LVDS) interface.

11. The method according to claim 7, wherein the first L2H interface comprises a low-voltage differential signaling (LVDS) interface.

12. A display architecture comprising:

a display;

a low voltage integrated circuit manufactured using a first process and configured to:

receive an input signal from a timing controller;

process the input signal; and output uncompressed pixel data based on the processed input signal;

a first high voltage integrated circuit manufactured using a second process, wherein the first process is a smaller process node than the second process and configured to drive pixels in the display based on the uncompressed pixel data; and a second high voltage integrated circuit manufactured using the second process and configured to drive pixels in the display based on the uncompressed pixel data;

wherein the low voltage integrated circuit is configured split the input signal into a first stream and a second stream and configured to provide the first stream to the first high voltage integrated circuit via a first low-to-high (L2H) interface, and wherein the low voltage integrated circuit is configured to provide the second stream to the second high voltage integrated circuit via a second low-to-high (L2H) interface, and wherein the low voltage integrated circuit, the first high voltage integrated circuit, and the second high voltage integrated circuit are assembled on a film.

13. The display architecture according to claim 12, wherein the input signal comprises an encoded input signal.

14. The display architecture according to claim 12, wherein the first L2H interface comprises a low-voltage differential signaling (LVDS) interface and the second L2H interface comprises a LVDS interface.

* * * * *